United States Patent [19]

Kunstler

[11] 3,937,155

[45] Feb. 10, 1976

[54] COMBUSTION FURNACE PARTICULARLY FOR BURNING REFUSE

[76] Inventor: Hans Kunstler, Eulenweg 25, 8048 Zurich, Switzerland

[22] Filed: Oct. 8, 1974

[21] Appl. No.: 513,073

[30] Foreign Application Priority Data

Oct. 8, 1973 Switzerland ..... 14295/73

[52] U.S. Cl. ..... 110/18 R; 110/10; 110/38; 110/72 R

[51] Int. Cl.[2] ..... F23G 5/00; F23B 1/22

[58] Field of Search ..... 110/18 R, 72 R, 75, 38

[56] References Cited

UNITED STATES PATENTS

| | | | |
|---|---|---|---|
| 3,041,986 | 7/1962 | Reilly | 110/10 |
| 3,055,320 | 9/1962 | Bolda | 110/38 |
| 3,057,308 | 10/1962 | Knipping | 110/8 |
| 3,371,629 | 3/1968 | Engdahl et al. | 110/75 |
| 3,395,655 | 8/1968 | Guy | 110/75 |
| 3,413,938 | 12/1968 | Dvirka | 110/38 |

*Primary Examiner*—Kenneth W. Sprague
*Attorney, Agent, or Firm*—McGlew and Tuttle

[57] ABSTRACT

A combustion furnace particularly for burning refuse comprises a furnace housing having an inlet adjacent one end and a discharge chute at the opposite end. A grate extends between the inlet for the material to be burned and the discharge and it slopes downwardly toward the discharge but it includes step portions each of which has a grate part which slopes in a direction opposite to the overall sloping of the grate. The overall slope of the grate is about 10° to 20° from the horizontal while the sloping of the individual stepped portions is from between 5° and 10°.

9 Claims, 6 Drawing Figures

COMBUSTION FURNACE PARTICULARLY FOR BURNING REFUSE

BACKGROUND OF THE INVENTION

1. Field of the Invention

This invention relates in general to the construction of furnaces for burning refuse and in particular to a new and useful furnace which includes a grate which slopes downwardly from the inlet to the discharge and which includes a plurality of stepped portions each having grate sections which slope in an opposite direction to the overall slope of the grate.

2. Description of the Prior Art

Combustion furnaces for burning refuse are known which include individual grate portions or zones which slope downwardly in the same general direction as the entire grate that is in the direction of advance of the material to be burned. In most cases the main inclination of the grate is approximately from between 20° and 30° and the sloping angle of the individual zones is about from 5° to 10°. Such a known design has the disadvantage that in the zones which are inclined in the same direction as the entire grate the material which is introduced to be burned has a tendence to roll from zone to zone due to the relatively great general inclination of the grate. In addition it is urged further toward the discharge area by the slope of the zone so that the period of dwell of the material in the fireplace which is necessary for completion of incineration is not attained. In addition the material which does not tend to move in a rolling motion toward the discharge end is not sufficiently turned over or rearranged in the individual zones and a completely satisfactory burning is prevented.

SUMMARY OF THE INVENTION

The present invention is an improvement over the prior art in respect to the construction of the grate wherein the grate includes individual step portions which slope downwardly in a direction opposite to the overall downward sloping of the grates in the inlet to the discharge. The construction affords a completely regular transportation of the material to be burned from the inlet to the discharge and prevents a rolling away in the zones of any portion of the material and at the same time insures a fully satisfactory turnover of the material in the individual zones. During the movement of the material to be incinerated it does not roll away in the general slope direction of the grate but moves backwardly slightly in each individual zone so that a turnover effect is obtained which is increased by the general pushing of the material by the grate bars. It has been found that a general inclination of the grate of from between 10° and 20° and an opposite inclination of the individual grate portions or steps of between 5° and 10° is particularly advantageous. This also makes it possible to obtain sufficiently high rises between the zones and thereby to design the rise walls for blowing secondary air therethrough which serves both a better cooling of the rise walls and a better combustion of the material.

The design makes it possible to achieve optimal combustion conditions in each of the individual zones or steps by supplying secondary air at the right locations and in sufficient quantities so that in each zone all combustible constituents are completely burnt down as much as possible. This is obtained by a conjoint action of a plurality of secondary air stream which issue from the furnace walls transversely to the advance direction above the grate. Secondary air streams sweep over the grate at certain spacings along its length in or against the advance direction of the material so that the secondary air streams not only supply enough combustion air but also blow the flames inwardly off the furnace walls and keep the flames concentrated immediately above the grate by limiting their height.

Accordingly it is an object of the invention to provide an improved furnace for burning particularly refuse material which includes a grate which slopes downwardly from an inlet to a discharge of the furnace housing and which includes individual portions or steps which slope in a direction opposite to the overall sloping of the grate.

A further object of the invention is to provide an improved furnace for burning refuse which includes a wall construction in the form of a divided hollow interior with baffling to permit a supply of air downwarldy from the roof portion and along the side walls and inwardly at a plurality of locations over the individual grate sections and for the return of excess air upwardly on the exterior of a partition baffle within the wall to a discharge at the upper end of the furnace and to a location for supplying some air below the grate sections.

A further object of the invention is to provide a furnace particularly for burning refuse which is simple in design, rugged in construction and economical to manufacture.

For an understanding of the principles of the invention reference is made to the following description of a typical embodiment thereof as illustrated in the accompanying drawings.

GENERAL DESCRIPTION OF THE PREFERRED EMBODIMENT

Figure 1:
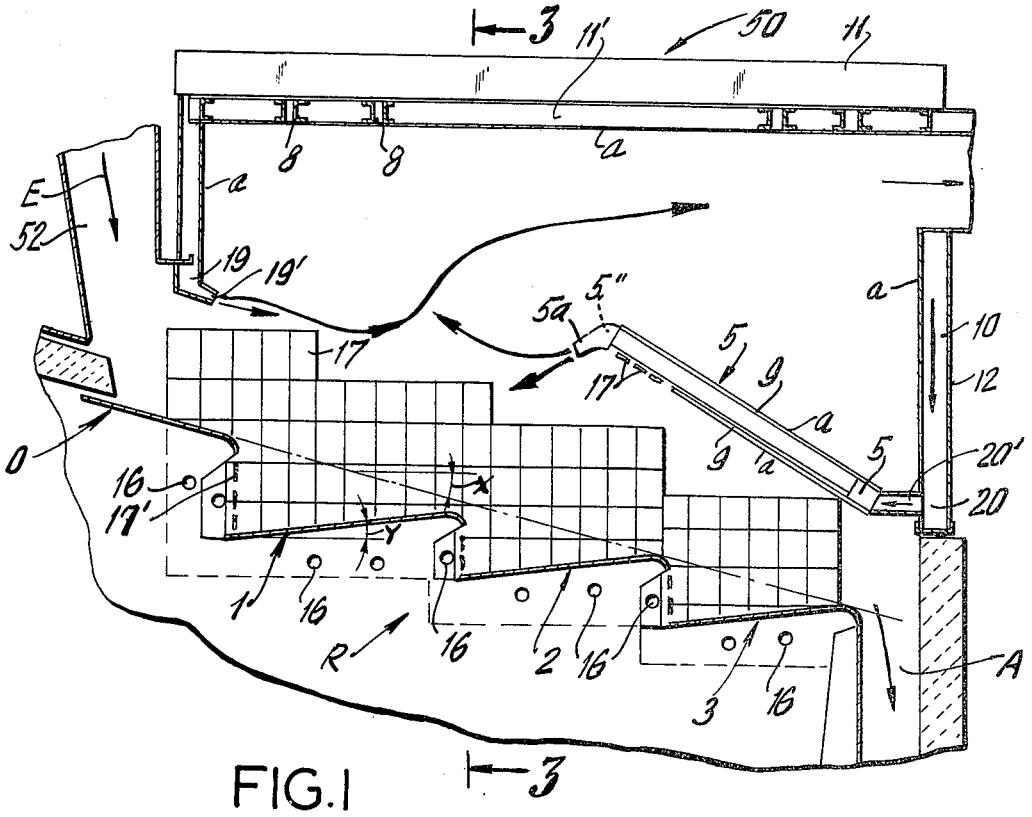
FIG. 1 is a partial vertical sectional view partly schematic of an incinerator constructed in accordance with the invention.

Referring to the drawings in particular the invention embodied therein comprises a combustion furnace particularly for incinerating rubbish which includes a housing generally designated 50 having an inner wall formed on base plates 9 spaced inwardly from an outer wall 12 which leaves a hollow space which is separated by an intermediate partition wall 13. The housing includes an inelt 52 for the inflow of material to be burned in the direction of the arrow E shown in FIG. 1. A discharge A for the material is located at the other end of the housing.

In accordance with the invention a grate generally designated R extends between an inlet area O for the material to be burned and the discharge chute A and it has an overall slope downwardly in the direction of the discharge which forms an angle X relative to the horizontal of about 15° for example and which is advantageously within the range of 10° to 20°. The grate R includes individual portions or steps 1, 2, 3, which are sloped in a direction opposite to the overall slope of the grate R by an angle Y in respect to the horizontal.

Figure 2:
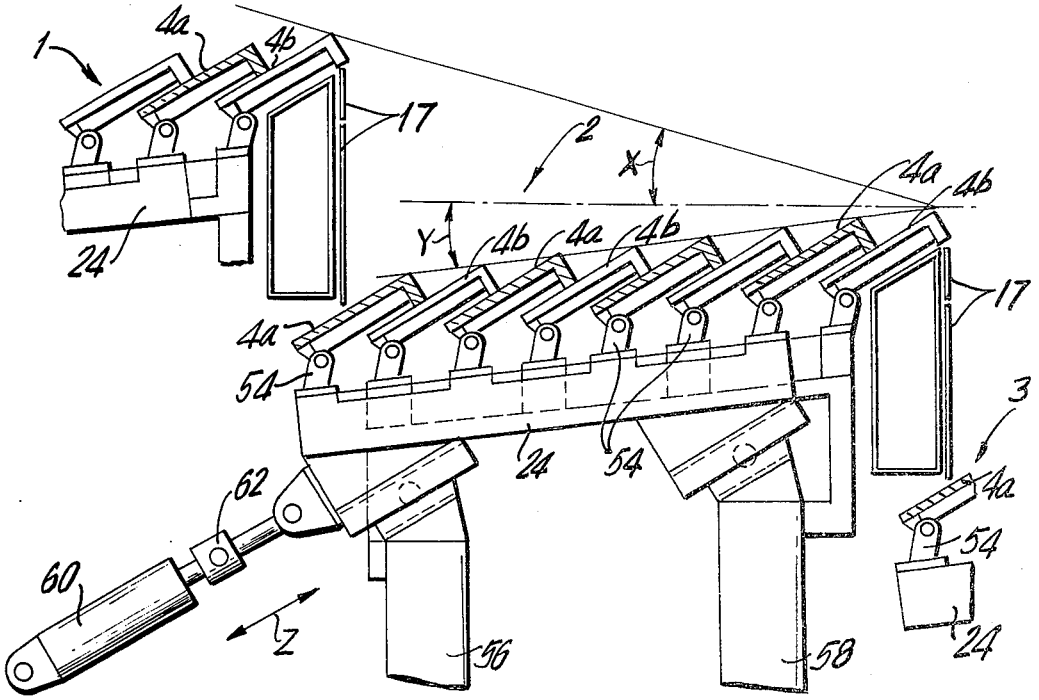
FIG. 2 is an enlarged partial sectional view of a portion of the incinerator grate shown in FIG. 1.

As best shown in FIG. 2 each grate section 1, 2, 3 includes a slide base 24 having individual upstanding pivot brackets 54 arranged at spaced locations along its length and which pivotally support inner ends of individual grate bars *4a*, *4b*. The grate bars *4a* and *4b* have outer ends which overlap the next adjacent bar and they are held by the slide 24 so that they will have an overall downward slope Y as indicated. The slide 24 is mounted on supports 56 and 58 which permit the back and forward movement of the slide during the drive of a fluid drive motor generally designated 60 having a connecting piston rod 62 which reciprocates in the direction of the arrows Z. The movement of the slide 24 backwardly and forwardly during its reciprocation causes the transportation step by step of the material to be burned within the individual steps or sections 1, 2 and 3. Because of the slight rise of the individual steps in the direction of advance of the material the transport of the material is carried out without an undesirable rolling forward of the material. In addition this construction insures a slight beaming up and falling back of the material at the advance by means of the shaking of the grate bars *4a*, *4b* which is analogous to the breaking of a wave. There is a coarse overturning obtained by the dropping of the material down each stepped portion to the next adjacent step and this results in a fine overturning of the material so that during the advance of the grate when moved by the motor 60 the material is continuously moved and overturned and thus subjected to combustion in all parts.

The fireplace walls and also the riser walls of the grate have to withdraw heat from the fireplace only to an extent necessary to hold down the surface temperature that is to hold this temperature at a level below the melting temperature of the ash. The withdrawn local heat turns almost completely into the fireplace again with the primary and secondary air. The cooling and preheating correspond to each other. The construction necessary for this purpose is simple and can be thermically computed in all respects.

For this purpose the furnace housing 50 includes a plate 17 which is suspended from the furnace walls limiting and facing the fireplace above the grate. The hollow space 10 between the inner wall plates 9 and the outer wall 12 provides a space for the circulation of the combustion air. Base plates 9 are provided with ribs at the inside and they also include openings 9'' in which hooks of plate 17 are engaged and through which the secondary air may flow past the plate 17 into the fireplace so that the plates are slightly cooled and the air is preheated. Plates 17 are to be provided at any place where an accumulation of heat is expected thus at the rises of the grate and at the walls adjacent the grate.

Figure 3:
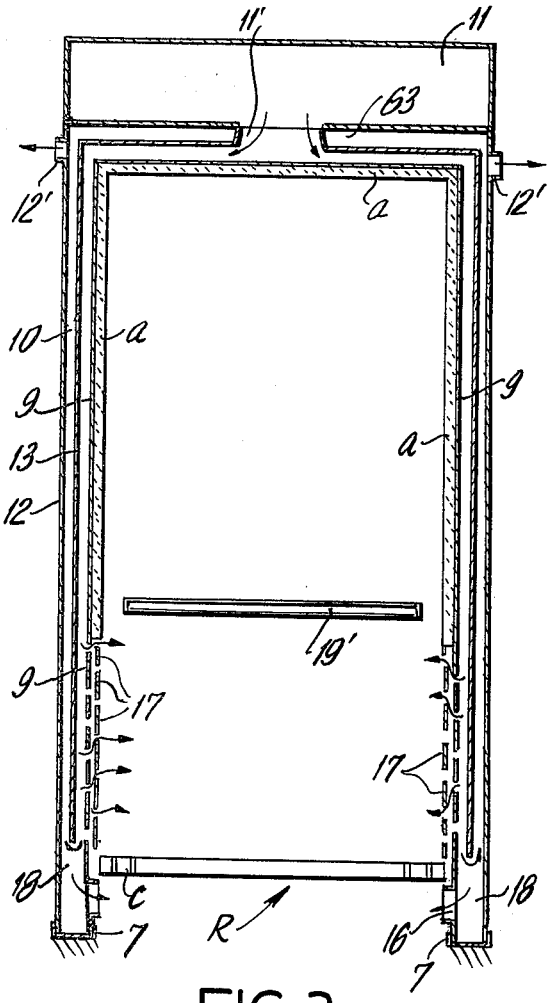
FIG. 3 is a vertical sectional view taken along the line 3—3 of FIG. 1.
Figure 4:
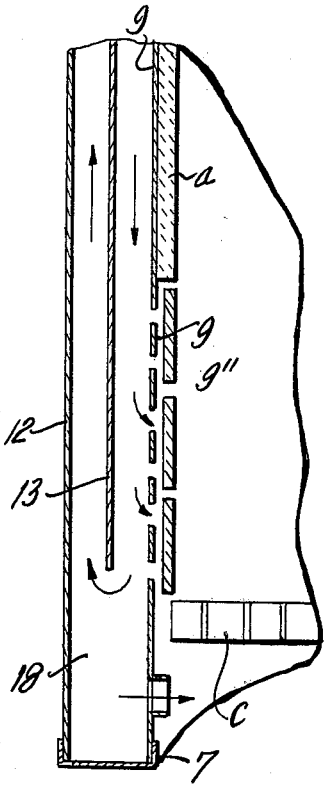
FIG. 4 is an enlarged partial view of the section shown in FIG. 3.
Figure 5:
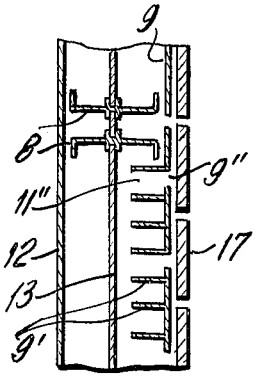
FIGS. 5 and 6 are further enlarged partial sectional views of the wall portion shown in FIG. 3.
Figure 6:
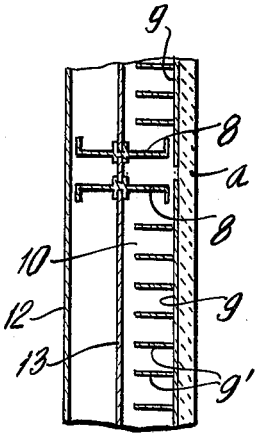

As shown in FIG. 3 there is a partition 13 which divides the space 10 between the base plates 9 and the outer wall 12 both at the sides and the top of the furnace. The furnace wall construction is formed of a plurality of channel bars 8 which are disposed in pairs and which are supported by a base frame 7. The inner walls or base plates 9 are provided in the upper portion of the furnace with a covering of a ceramic material or thermal insulation. The inner wall 9 also carries ribs 9' which extend inwardly between the inner wall and the partition 13 and the number and extent thereof are chosen in order to regulate the velocity of the air and the thermal flow in the interior passages of a furnace wall.

The base plates 9 in the area of the insulation are provided with slits but are not perforated so that the air is forced to flow downwardly to the plate 17 where part of it moves further downwardly to the lower cavity 18 below the partition wall 13 and through openings 16 located below the grate R. The grate R advantageously includes openings *c* in the individual grate elements *4a* and *4b*. Thus air enters through the roof superstructure 11 and is propelled for example by a blower (not shown) to move through an inlet passage 11' and flow to each side of the roof 62 and downwardly between the base plate wall 9 and the partition 13. The flow of air cools the nonperforated plate 9 which is covered by the ceramic coating *a* and it passes through the openings in the plate 17 or the openings 16 to provide air for combustion both above and below the grate. When the air supplied is in excess a part of this excess will escape upwardly through the space between the partition 13 and the outer wall 12 and in so doing it tends to cool the surface of the outer wall.

With the construction of the invention heat losses are very small even without special insulation and nevertheless the inner skin of the furnace is sufficiently cooled. This construction also permits a reliable thermal calculation of the amount of heat which is to be retained or circulated outwardly to atmosphere. The temperature of the plates in the inner portions of the channel bars may amount to more than 400°C while the furnace exterior wall 12 remains below 100°C.

The front and back walls of the furnace have the same structure as the lateral walls in the roof. The lowermost part of the wall cavities where the base plates 9 have no ribs serves as a secondary air collector 19 and 20. At the side facing the fireplace collector 19 is screened by suspended plates 17 at this location of the inlet to the furnace. The collector 19 has orifices 19' through which secondary air is blown over the material to be burned and directed in the transport direction of the grate R. The collector 20 at the back wall supplies a lower collector 5' of a fire bridge 5 through tubes 20'. The fire bridge is also designed as a panel-like hollow section having base plates 9 which are covered above and below with a ceramic layer and which have ribs in the interior. The upper collector 5'' directs the preheated secondary air through orifices *5a* of nozzles in a direction opposite to the transport direction of the grate and the air passes over the grate. Because of the large amount of heat accumulation the bridge 5 is also provided with plates 17 below the upper collector 5'' and at the front side in the zone of orifices *5a*. Plates 17 keep the hot fire gases away from the bridge and the nozzles since they particularly strongly affect the nozzles due to the suction effect of the secondary air streaming from the orifices *5a*.

In larger units in some instances the fireplace is provided with water-cooled boiler walls. Such a structure would be limited to parts having a ceramic insulating protection. The fire bridge would then be omitted and this would simplify the boiler construction. Below the front and rear boiler drum the collectors 19 and 20 would remain as secondary air conduits. The plates 17 however would be maintained in view of the important function of these plates to permit the air to flow over the grates. Finally the panel-like sections 1, 2 and 3 would have a lesser angle of negative inclination.

While a specific embodiment of the invention has been shown and described in detail to illustrate the application of the principles of the invention, it will be understood that the invention may be embodied otherwise without departing from such principles.

The embodiments of the invention invention in which an exclusive property or privilege is claimed are defined as follows:

1. A combustion furnace particularly for burning refuse, comprising a furnace housing having an inlet adjacent one end for the infeed of material to be burned and a discharge spaced from said inlet, and a grate extending between said inlet and said discharge and having an overall sloping angle sloping downwardly to said discharge, said grate including a plurality of separate individual grate step portions arranged one after the other between said inlet and said discharge and each sloping downwardly in a direction opposite to said overall slope of said grate.

2. A combustion furnace according to claim 1, wherein said overall slope of said grate comprises an angle of from 10° to 20° with the horizontal and the individual slope of the grate step portions comprises from 5° to 10° relative to the horizontal.

3. A combustion furnace according to claim 1, wherein said furnace housing is of double wall construction and defines an air flow passage between said double walls said passage having openings into said furnace above and below said grate.

4. A combustion furnace particularly for burning refuse, comprising a furnace housing having an inlet adjacent one end for the infeed of material to be burned and a discharge spaced from said inlet, and a grate extending between said inlet and said discharge and having an overall sloping angle sloping downwardly to said discharge, said grate including a plurality of separate individual grate step portions arranged one after the other between said inlet and said discharge and each sloping downwardly in a direction opposite to said overall slope of said grate, said housing including spaced inner and outer walls and an intermediate partition arranged in substantially parallel relationship and defining an inflow passage for air between the intermediate wall and the inner wall from the top of said furnace along each side, said inflow passage having openings into said furnace in the vicinity of said grate and the space between said partition wall and the outer wall defining a return conduit communicating with the end of said inflow conduit for the outflow of the air which is in excess of that required for combustion.

5. A combustion furnace construction according to claim 4, wherein said inner wall comprises a base plate having an upper portion with an interior heat insulation thereon and a lower portion forming a plurality of panels having a plurality of vertically spaced openings through which the air may pass, the interior of said fireplace including a plurality of plates having hooks which engage into some of the openings of said inner wall.

6. A combustion furnace according to claim 5, including a plurality of channels extending from said air flow space into the interior of said furnace and providing separate flow orifices for the inflow of combustion air at spaced locations along the length of said grate between said inlet and said discharge.

7. A combustion furnace according to claim 4, including a fire bridge conduit extending into said furnace from the end thereof adjacent said discharge chute toward said inlet and terminating in a nozzle directed downwardly against said grate said bridge having a fire flow conduit connection to said nozzle to said furnace wall, said furnace wall comprising a double wall having an interior space for the inflow of air thereto.

8. A combustion furnace according to claim 4, including a tube boiler mounted above said grate, said furnace having a double wall formation having an inflow passage between said walls for the inflow of combustion air which leads into said furnace in the vicinity of said grate.

9. A combustion furnace according to claim 1, wherein each of said grate step portions comprise a plurality of individual grate members arranged in overlapping relationship, means pivotally mounting each of said grate members at their inner ends so that their outer top ends extends downwardly from the edge of said step so that the overall slope of said step is downwardly in a direction opposite to the overall slope of said grate.

* * * * *